US005579947A

United States Patent [19]

Yemini

[11] Patent Number: 5,579,947

[45] Date of Patent: Dec. 3, 1996

[54] ORGANIZER LATCH MECHANISM

[75] Inventor: Zvi Yemini, Tel Aviv, Israel

[73] Assignee: Zag Ltd., Rosh Haayin, Israel

[21] Appl. No.: 593,199

[22] Filed: Jan. 29, 1996

[51] Int. Cl.[6] ..... B65D 85/48

[52] U.S. Cl. ..... 220/554; 220/324; 294/162; 294/146; 294/148; 206/1.5

[58] Field of Search ..... 220/324, 553, 220/554, 555, 556; 206/1.5; 294/162, 146, 148; 292/194, 304

[56] References Cited

U.S. PATENT DOCUMENTS

| | | | |
|---|---|---|---|
| 3,317,097 | 5/1967 | Giordano | 220/324 |
| 4,061,371 | 12/1977 | Prather et al. | 220/324 |
| 4,176,315 | 11/1979 | Sunnarborg | 324/108 |
| 4,212,392 | 7/1980 | McKenzie | 312/123 |
| 4,669,772 | 6/1987 | Waccer, Jr. | 294/162 |
| 4,865,186 | 9/1989 | Gaigs | 206/5 |
| 4,901,892 | 2/1990 | Song | 222/498 |
| 4,974,740 | 12/1990 | Niles et al. | 220/324 |
| 5,429,240 | 7/1995 | Biebel et al. | 220/324 |

*Primary Examiner*—Joseph M. Moy
*Attorney, Agent, or Firm*—Mark M. Friedman

[57] ABSTRACT

An organizer which includes a body formed with a cavity and ribs which divide the cavity into two or more chambers. The organizer further includes a number of partitions which are perpendicular to the ribs so as to define a number of chambers. The organizer includes a permanent divider which extends perpendicular to the ribs and which is permanently connected to, or formed with, the body the ribs of the organizer. The organizer additionally includes a cover which is hingedly engaged to the body. A latch mechanism is mounted on the cover and partially extends through the cover for reversibly connecting the cover to the body through the engagement of a portion of the latch mechanism with said permanent divider.

7 Claims, 4 Drawing Sheets

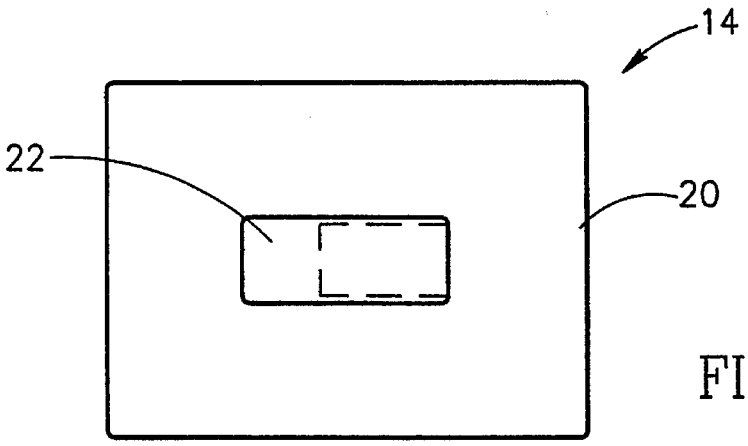
FIG.10
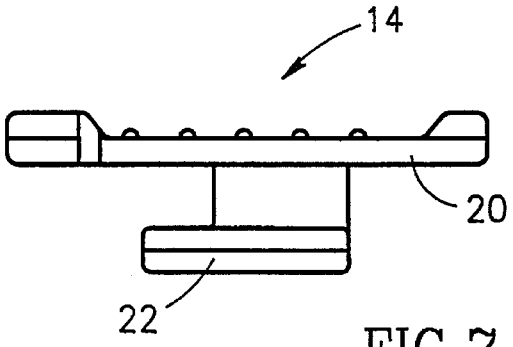
FIG.7
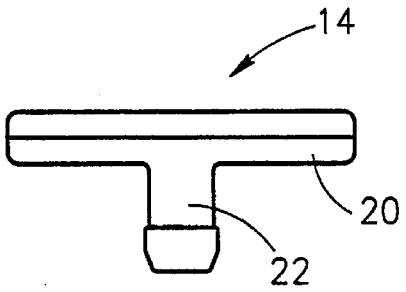
FG.9
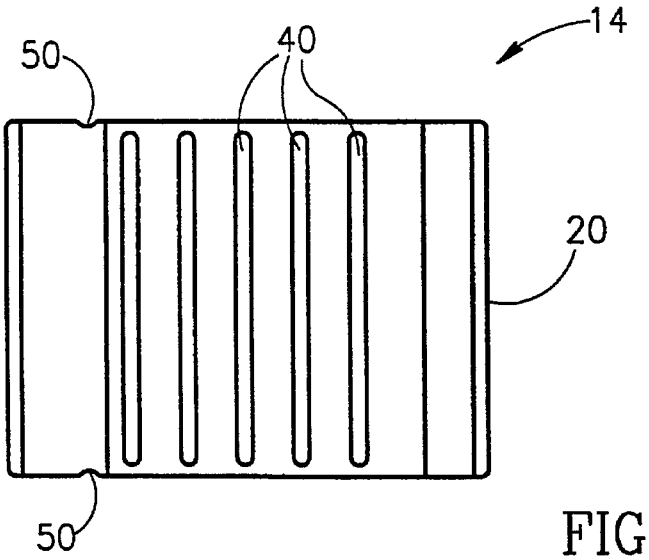
FIG.8

ORGANIZER LATCH MECHANISM

FIELD AND BACKGROUND OF THE INVENTION

The present invention relates to an organizer for storing a variety of small items, such as screws and bolts, for example, and, more particularly, to a mechanism for effectively latching an organizer to prevent the inadvertent opening of the organizer when not in use.

SUMMARY OF THE INVENTION

According to the present invention there is provided an organizer, comprising: (a) a body member formed with a cavity; (b) at least one rib dividing the cavity into two or more chambers; (c) a plurality of partitions extending substantially perpendicular to the at least one rib so as to define a plurality of chambers; (d) a permanent divider extending perpendicular to the at least one rib, the permanent divider being permanently connected to, or formed with, the body or the at least one rib; (e) a cover member having an outside surface, the cover member being hingedly engaged to the body member and serving to alternately cover and uncover the cavity; and (f) a latch mechanism mounted on the cover member and partially extending through the cover member for reversibly connecting the cover member to the body member through the engagement of a portion of the latch mechanism with the permanent divider.

According to further features in preferred embodiments of the invention described below, the cover member includes a cover member opening therethrough, wherein the permanent divider includes a permanent divider opening therethrough and wherein the latch mechanism includes: (i) a slidable element for sliding across the outside surface of the cover; (ii) a leg element connected to, or integrally formed with, the slidable element, a first portion of the leg element extending through the opening in the cover member and a second portion of the leg element alternately engaging and disengaging the permanent divider opening to alternately lock and unlock the cover and the body.

BRIEF DESCRIPTION OF THE DRAWINGS

The invention is herein described, by way of example only, with reference to the accompanying drawings, wherein:

FIG. 7 is a side view of a sliding member according to the present invention;

FIG. 8 is a top view of the sliding member of FIG. 7;

FIG. 9 is a front view of the sliding member of FIG. 7;

FIG. 10 is a bottom view of the sliding member of FIG. 7.

DESCRIPTION OF THE PREFERRED EMBODIMENTS

The present invention is of an organizer with an innovative latch mechanism.

The principles and operation of an organizer latch mechanism according to the present invention may be better understood with reference to the drawings and the accompanying description.

Figure 1:
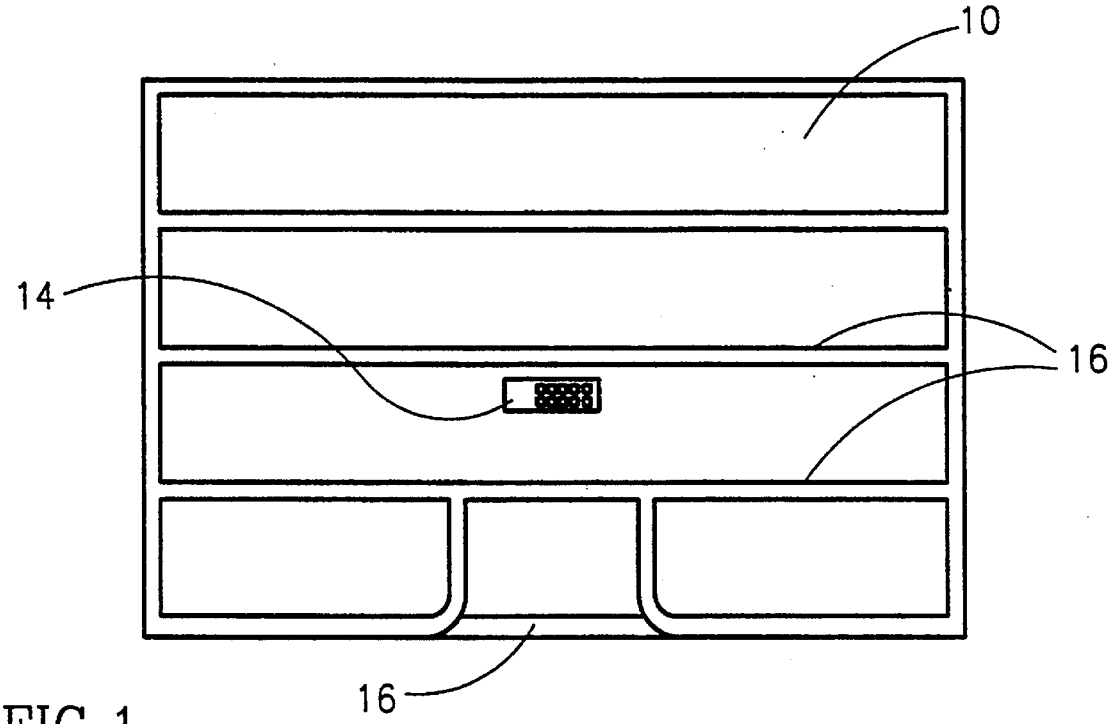
FIG. 1 is a top view of the top cover of a typical organizer showing a latch according to the present invention.
Figure 2:
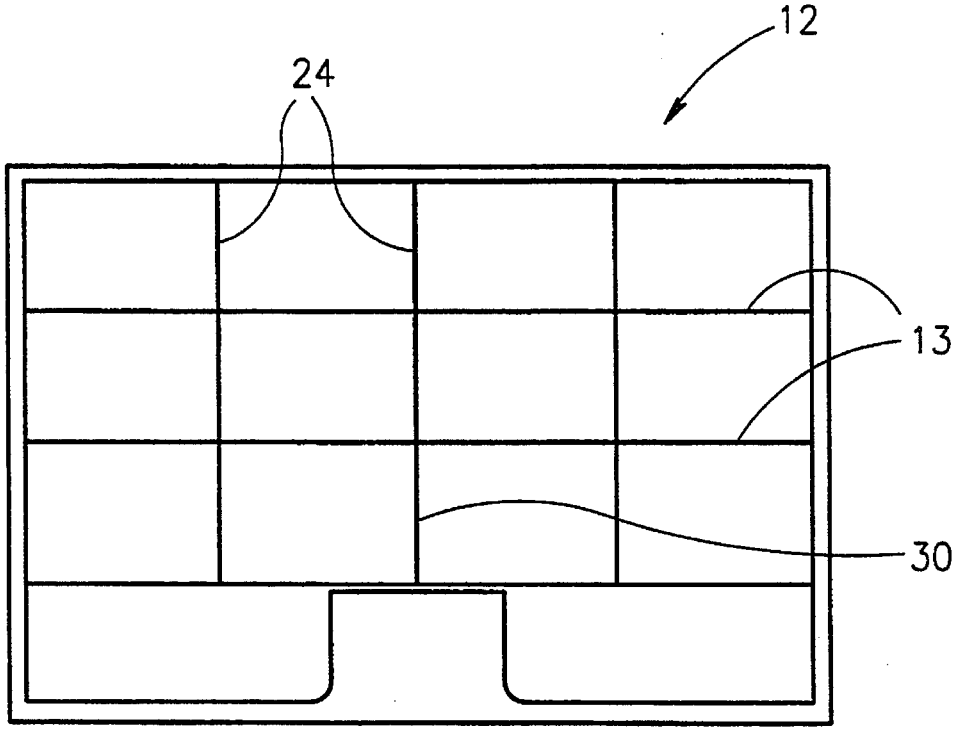
FIG. 2 is a top view of the organizer of FIG. 1 without the cover.

Referring now to the drawings, FIGS. 1 and 2 are top views of the two major components of an organizer, cover member 10 and body member 12, respectively. Shown in FIG. 1 is the outside surface of cover member 10, which is preferably at least partially transparent. Cover member 10 includes a latch mechanism 14 according to the present invention which is described in more detail below. Cover member 10 preferably also includes a handle 16 for facilitating the transporting of the organizer. Cover member 10 preferably also includes a number of outwardly extending protrusions 16 which serve to strengthen cover member 10 and enhance its aesthetic appeal of the outside surface of cover member 10.

As can be seen in FIG. 2, an organizer according to the present invention includes body member 12 which is formed with a cavity. Cover member 10 is hingedly engaged to body member 12 and serves to alternately cover and uncover the cavity. Connected to, or, preferably, formed with body member 12 are ribs 13 which divide the cavity into chambers. Further included are a number of partitions 24 which extend substantially perpendicular to ribs 13 so as to define a plurality of chambers for storing various items, such as, for example, screws, bolts, and the like. Partitions 24 are preferably removable so as to allow the user to at least partially define the size and shape of the chambers based on the user's specific needs.

The organizer further includes a permanent divider 30 which extends perpendicular to ribs 13. Permanent divider 30 is permanently connected to, or is formed with, body member 12 and/or one or more ribs 13.

An organizer according to the present invention is characterized in that it includes a latch mechanism 14 which is mounted on cover member 10 and which partially extends through an opening in cover member 10. Latch mechanism 14 is useful in reversibly connecting cover member 10 to body member 12 through the engagement of a portion of latch mechanism 14 with permanent divider 30, as described in more detail below.

Figure 3:
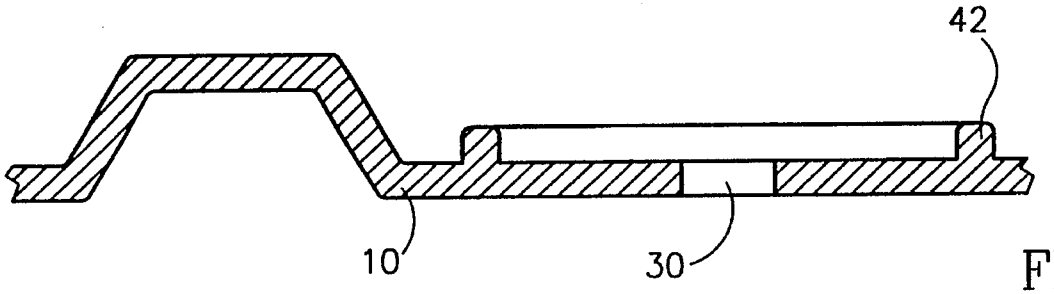
FIG. 3 is a side cross-sectional view of a portion of the cover of the organizer of FIG. 1.

One illustrative example of latch mechanism 14 according to the present invention is as shown in FIGS. 4–10 and with reference to FIG. 3. Shown in FIGS. 7, 8, 9 and 10 are side, top, end and bottom views of latch mechanism 14.

Latch mechanism 14 includes a slidable element 20, which is preferably substantially rectangular, for sliding across the outside surface of cover member 10. Latch mechanism 14 further includes a leg element 22 connected to, or integrally formed with, slidable element 20.

Figure 4:
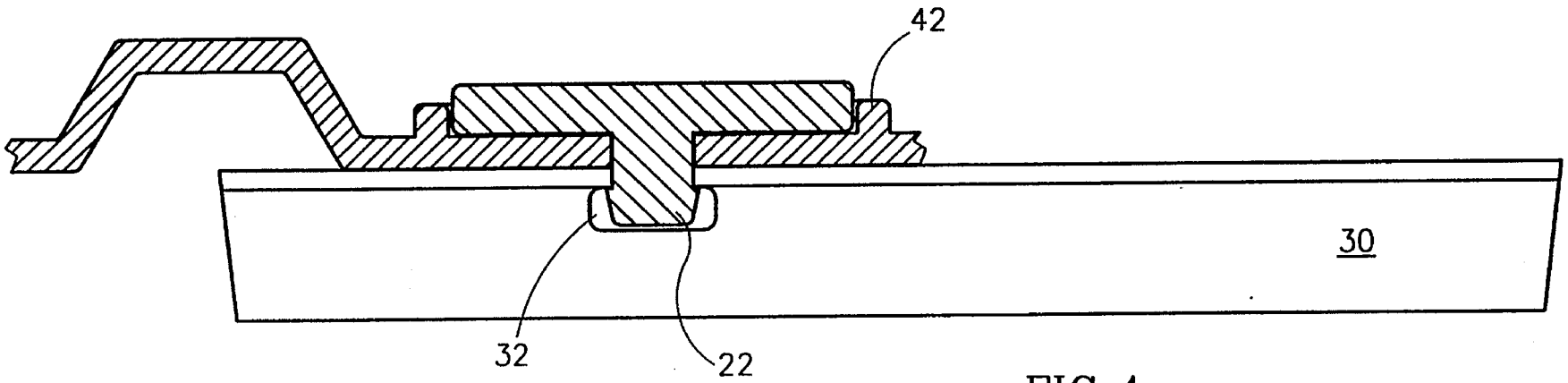
FIG. 4 is a side cross-sectional view as in FIG. 3 but showing a sliding member according to the present invention.
Figure 5:
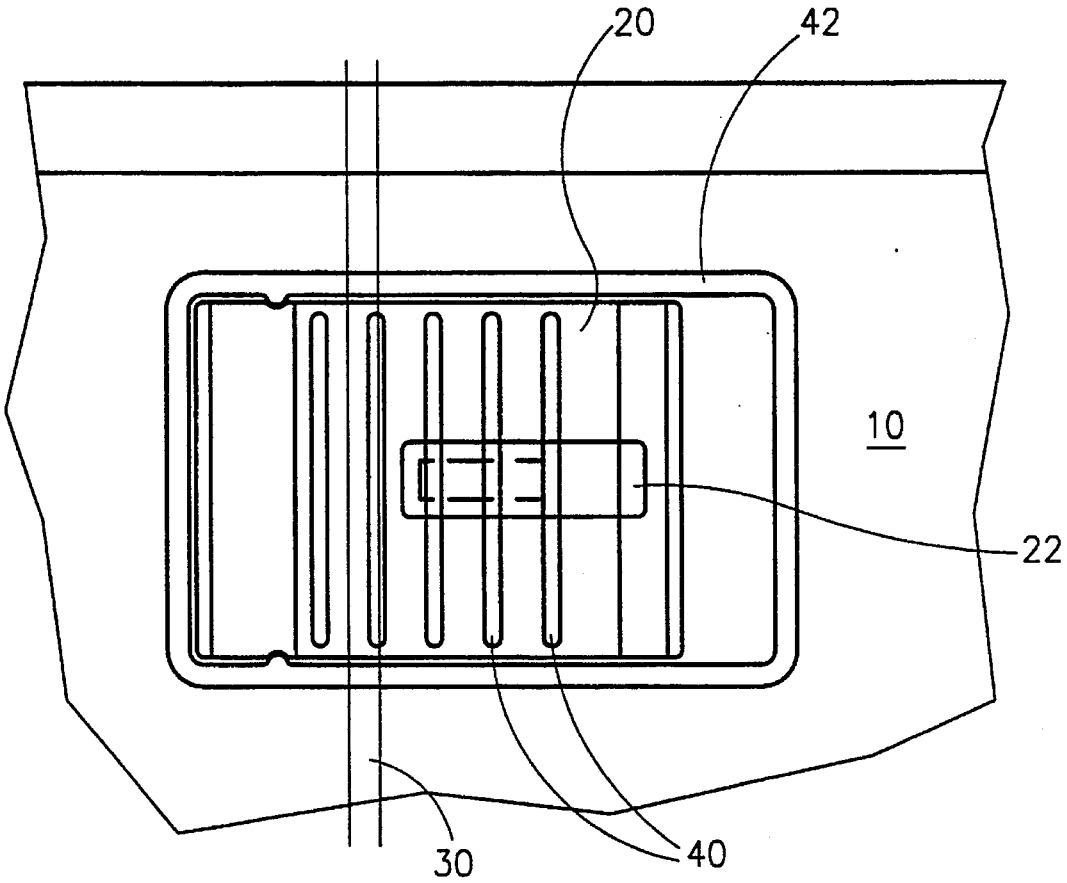
FIG. 5 is a top view of the sliding member of FIG. 4 also showing a portion of the cover of the organizer.
Figure 6:
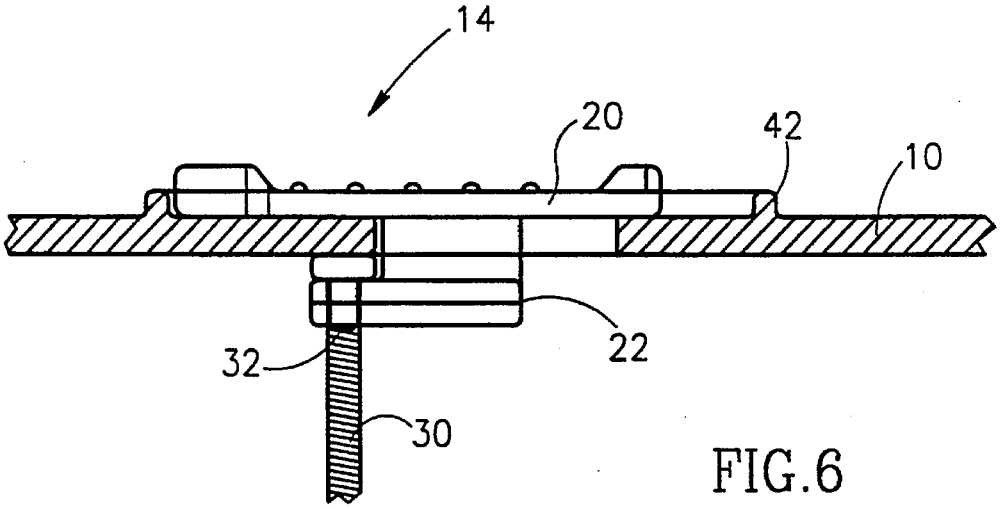
FIG. 6 is a side view of the sliding member and cover of FIG. 5 also showing the anchoring divider.

As can be seen in FIG. 3, cover member 10 features an opening 30 therethrough which accommodates a portion of leg element 22 of latch mechanism 14 (FIG. 4).

Latch mechanism 10 is located on cover member 10 such that when said cover member 10 is closed over body member 12 latch mechanism 10 is adjacent permanent divider 30 (FIG. 4). Permanent divider 30 features an opening 32 therethrough (FIGS. 4 and 6) for accommodating a portion of leg element 22. Preferably, a portion of leg element 22 is enlarged (FIGS. 6 and 9) so as to prevent latch mechanism 10 from disengaging from cover member 10 once latch mechanism 10 has been inserted, as by pressing, into engagement with cover member 10.

Slidable element 20 preferably features a series of protrusions 40 (FIGS. 5 and 8) on its outward-facing side to increase friction between slidable element 20 and the user's finger so as to facilitate the sliding of slidable element 20.

Preferably, the leading and trailing edges of slidable element 20 are raised (FIGS. 6 and 7) so as to prevent the user's hand from inadvertently sliding over slidable element 20 during sliding of slidable element 20 to the locked or unlocked position.

Preferably, the outside surface of cover member 10 features an elevated border 42 (FIGS. 3–6) which is connected to, or permanently formed with, the outside surface of cover member 10. Border 42 borders slidable element 20 and confines its sliding movement between a locked position wherein leg element 22 is inserted within opening 32 in permanent divider 30 (FIGS. 6) and an unlocked position wherein leg element 22 is withdrawn from opening 32 in permanent divider 30.

To help retain slidable element 20 in the locked position so as to prevent the inadvertent unlocking of cover member 10, slidable element 20 preferably features one or more recessions 50 while border 42 is formed with one or more complementary inwardly directed protrusions 52 (FIG. 5) for accommodating recessions 50 when slidable element 20 is in the locked position so as to substantially immobilize slidable element 20 and prevent its inadvertent sliding in the absence of a directed force, such as that exerted by the user.

While the invention has been described with respect to a limited number of embodiments, it will be appreciated that many variations, modifications and other applications of the invention may be made.

What is claimed is:

1. An organizer, comprising:

(a) a body member formed with a cavity;

(b) at least one rib dividing said cavity into two or more chambers;

(c) a plurality of partitions extending substantially perpendicular to said at least one rib so as to define a plurality of chambers;

(d) a permanent divider extending perpendicular to said at least one rib, said permanent divider being permanently connected to, or formed with, said body member or said at least one rib;

(e) a cover member having an outside surface, said cover member being hingedly engaged to said body member and serving to alternately cover and uncover said cavity; and (f) a latch mechanism mounted on said cover member and partially extending through said cover member for reversibly connecting said cover member to said body member through the engagement of a portion of said latch mechanism with said permanent divider.

2. The organizer of claim 1, wherein said partitions are removable.

3. The organizer of claim 1, wherein said cover member is transparent.

4. The organizer of claim 1, wherein said cover member includes a cover member opening therethrough, wherein said permanent divider includes a permanent divider opening therethrough and wherein said latch mechanism includes:

(i) a slidable element for sliding across said outside surface of said cover member;

(ii) a leg element connected to, or integrally formed with, said slidable element, a first portion of said leg element extending through said opening in said cover member and a second portion of said leg element alternately engaging and disengaging said permanent divider opening to alternately lock and unlock said cover member and said body member.

5. The organizer of claim 1, wherein said slidable element features protrusions to facilitate sliding.

6. The organizer of claim 1, further comprising an elevated border connected to, or permanently formed with, said outside surface of said cover member, said border bordering said slidable element.

7. The organizer of claim 6, wherein said border features at least one inwardly extending protrusion and wherein said sliding member is formed with at least one complementary recession dimensioned and located to accommodate said at least one protrusion so as to at least partially immobilize said slidable element.

* * * * *